US005362255A

United States Patent [19]

Anhalt

[11] Patent Number: 5,362,255

[45] Date of Patent: Nov. 8, 1994

[54] COAXIAL CONNECTOR

[75] Inventor: John W. Anhalt, Orange, Calif.

[73] Assignee: ITT Corporation, Secaucus, N.J.

[21] Appl. No.: 120,494

[22] Filed: Sep. 14, 1993

[51] Int. Cl.[5] ..... H01R 17/04

[52] U.S. Cl. ..... 439/582; 29/862

[58] Field of Search ..... 439/582, 585; 29/862, 29/863

[56] References Cited

U.S. PATENT DOCUMENTS

| | | | |
|---|---|---|---|
| 3,660,805 | 5/1972 | McDonough | 339/183 |
| 3,699,504 | 10/1972 | Huber | 339/177 |
| 3,728,787 | 4/1973 | McDonough | 29/629 |
| 4,678,261 | 7/1987 | Mitani et al. | 439/582 |
| 4,708,414 | 11/1987 | Lam | 439/394 |
| 4,881,912 | 11/1989 | Thommen et al. | 439/585 |
| 4,932,898 | 6/1990 | Goodman et al. | 439/582 |
| 5,021,011 | 6/1991 | Kawanami et al. | 439/582 |
| 5,110,308 | 5/1992 | Nishikawa et al. | 439/582 |
| 5,133,677 | 7/1992 | Sato et al. | 439/585 |

FOREIGN PATENT DOCUMENTS

| | | | |
|---|---|---|---|
| 5152037 | 6/1993 | Japan | 439/582 |

*Primary Examiner*—Eugene F. Desmond

*Attorney, Agent, or Firm*—Thomas L. Peterson

[57] ABSTRACT

A coaxial connector is described, of the type that has a shell (14, FIG. 1) with a tubular first portion (16) whose front mates with another connector and whose extreme rear end (64) is initially open, and which has a second portion (22) extending at a right angle to the first portion for mechanically and electrically terminating to the braiding (42A) of a coaxial cable (30). The second portion (22) of the shell forms a tubular ferrule that surrounds the cable inner insulation (40) and which is surrounded by the cable braiding. The connector includes a sleeve (46) which can slide along the cable to a position surrounding the braiding that surrounds the ferrule, so crimping of the sleeve locks the braiding between the ferrule and sleeve. The shell second portion includes first and second parts (50, 52) that extend respectively from the lower and upper sides (60, 62) of the rearward end (56) of the first shell portion, with the second part being bendable and each part forming about half of the tubular ferrule. The second part (52) extends rearwardly from the upper side of the shell first portion while lying above the mate axis (12) of the first shell portion to provide access for a soldering iron to reach into the initially open rear end of the first shell portion.

10 Claims, 4 Drawing Sheets

COAXIAL CONNECTOR

BACKGROUND OF THE INVENTION

One type of coaxial connector has a first portion that mates with another connector and has a second portion extending at a right angle to the first portion and designed to terminate to a coaxial cable. One prior art coaxial connector of this type, described in U.S. Pat. No. 5,110,308, includes a shell that forms the outside of both right angle portions, the rear end of the first shell portion being initially open to enable a soldering operation or the like, but being closed by a part of the second shell portion which is bent to close the open end.

Several problems arise in the use of the above type of prior art coaxial connectors. One problem is that it is inconvenient to neatly place the cable braiding between inner and outer tubes which are then crimped to lock the braiding in place, and the crimp connection is not highly reliable. Also, there is not good access to the rear end of the first shell portion for a soldering operation or the like, during the termination. A coaxial connector with largely right angle portions, which assure neat placement of the braiding and secure crimping of the braiding in place, while providing good access to the rear end of the first shell portion for soldering operations or the like would be of value.

SUMMARY OF THE INVENTION

In accordance with one embodiment of the present invention, a coaxial connector is provided of the type that has angled first and second portions in the final configuration, which assures a high quality mechanical and electrical connection to a cable braiding and which leaves the rear end of the first portion open prior to bending of part of the second portion to the final configuration. The connector includes a sleeve that can slide along the cable to a position to closely surround a braiding that closely surrounds a ferrule of the second shell portion, so that crimping of the sleeve provides a good mechanical and electrical termination to the cable braiding. The second shell portion includes a first part that extends largely perpendicular to the first shell portion and that forms half of the ferrule, with the second part, which is bendable, forming the other half of the ferrule. In the initial shell configuration, the second part extends rearwardly, but lies at a height above the mating axis of the first shell portion.

In the termination of a cable, the braiding is initially spread so the inner cable insulator can be readily placed in half of the ferrule and the two halves of the ferrule can be closed together. The sleeve then irons the braiding to a largely cylindrical configuration to closely surround the ferrule and lie closely within the sleeve.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
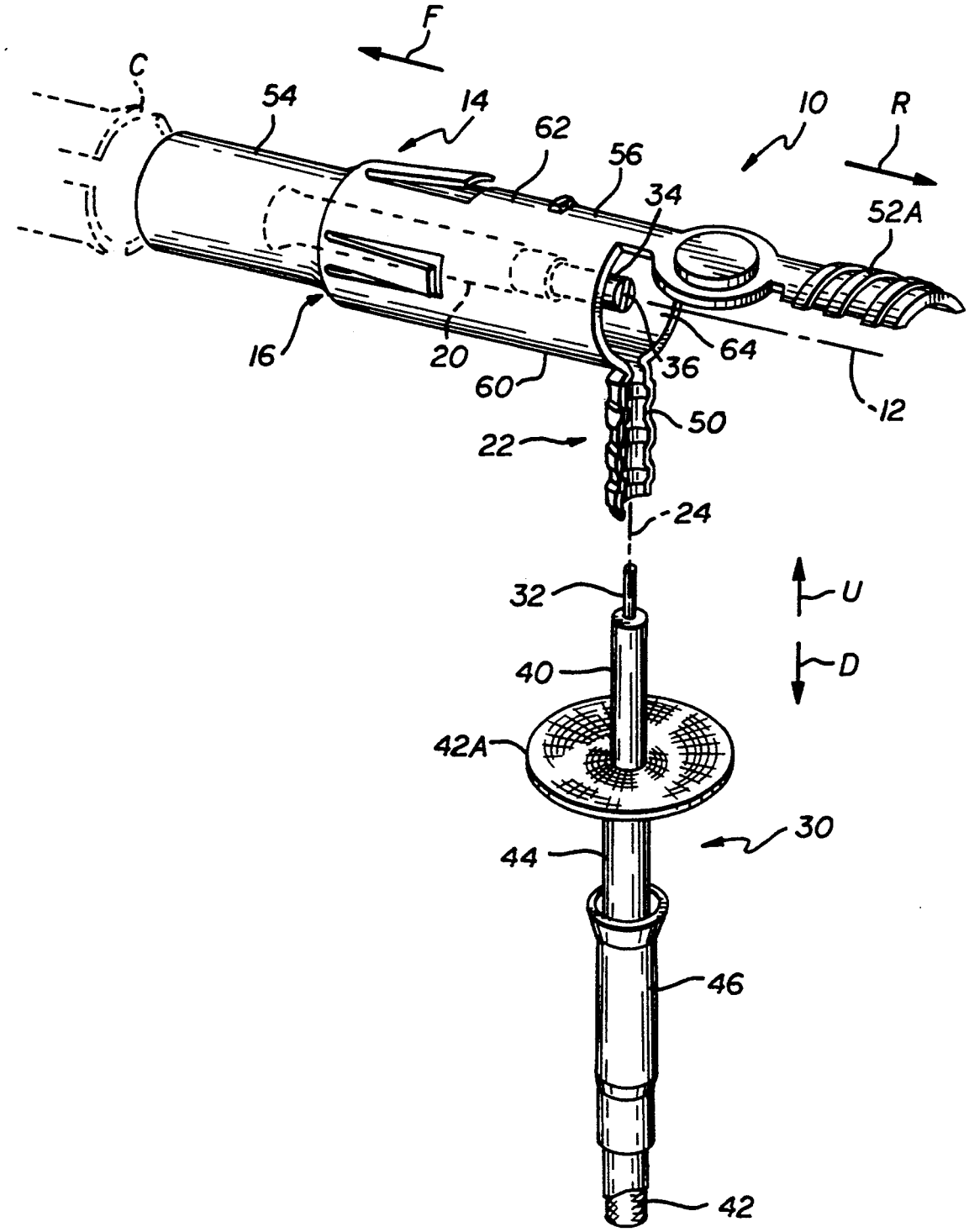
FIG. 1 is an exploded isometric view of a coaxial connector of the present invention, and of a cable, with the shell in its initial configuration and with the braiding of the cable in its spread out configuration.

FIG. 1 illustrates a coaxial connector 10 which is designed to mate with another connector C by moving the connector in a forward direction F along a mate axis 12. The connector includes a shell 14 that has a tubular first portion 16 that extends along the mate axis 12 and that holds a contact assembly 20. The shell also has a second portion 22 which, at least in the final configuration of the connector, extends along a termination or ferrule axis 24 that is largely perpendicular to the mate axis 12. The second portion 22 is designed to terminate to a major portion of a coaxial cable 30. The coaxial cable includes an inner conductor 32 that is designed to connect to an inner contact 34 of the contact assembly 20, as by placing the inner conductor 32 in a slot 36 of the inner contact and soldering them together. The cable also includes an inner insulator 40 that surrounds the inner conductor, a braiding 42 that surrounds the inner insulator 40, and a jacket 44 that surrounds the braiding. The braiding 42 initially extends in a tubular shape, but is shown in a spread out configuration at 42A wherein it has been deformed away from its initial tubular shape. The connector also includes a sleeve 46 which can slide along the cable.

Figure 4:
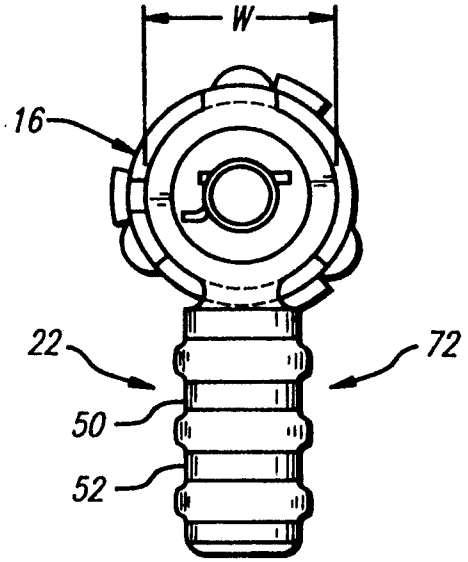
FIG. 4 is a rear view of the connector of FIG. 2 in its final configuration.

The tubular first shell portion 16 has forward and rearward ends 54, 56, and has lower and upper sides 60, 62. The second shell portion 22 has first and second termination parts shown at 50, 52A. The first part 50 extends downwardly from the lower side 60 of the rearward end 56 of the shell first portion, when the mate axis 12 extends largely horizontally. The second termination part is shown at 52A extending primarily rearwardly, in a rearward direction R from the upper side 62 of the rearward end 56 of the shell first portion. This initial configuration results in an open extreme rear end 64 for the shell first portion. The open extreme rear end 64 permits a soldering iron or other device to be projected therethrough to complete the connection of the cable inner conductor 32 to the connector inner contact 34. A common size of connector of the type illustrated, has an open rear end 64 of a width W (FIG. 4) of about four millimeters, or 0.16 inch, so it is desirable for the open rear end 64 (FIG. 1) to be as open as possible.

Figure 2:
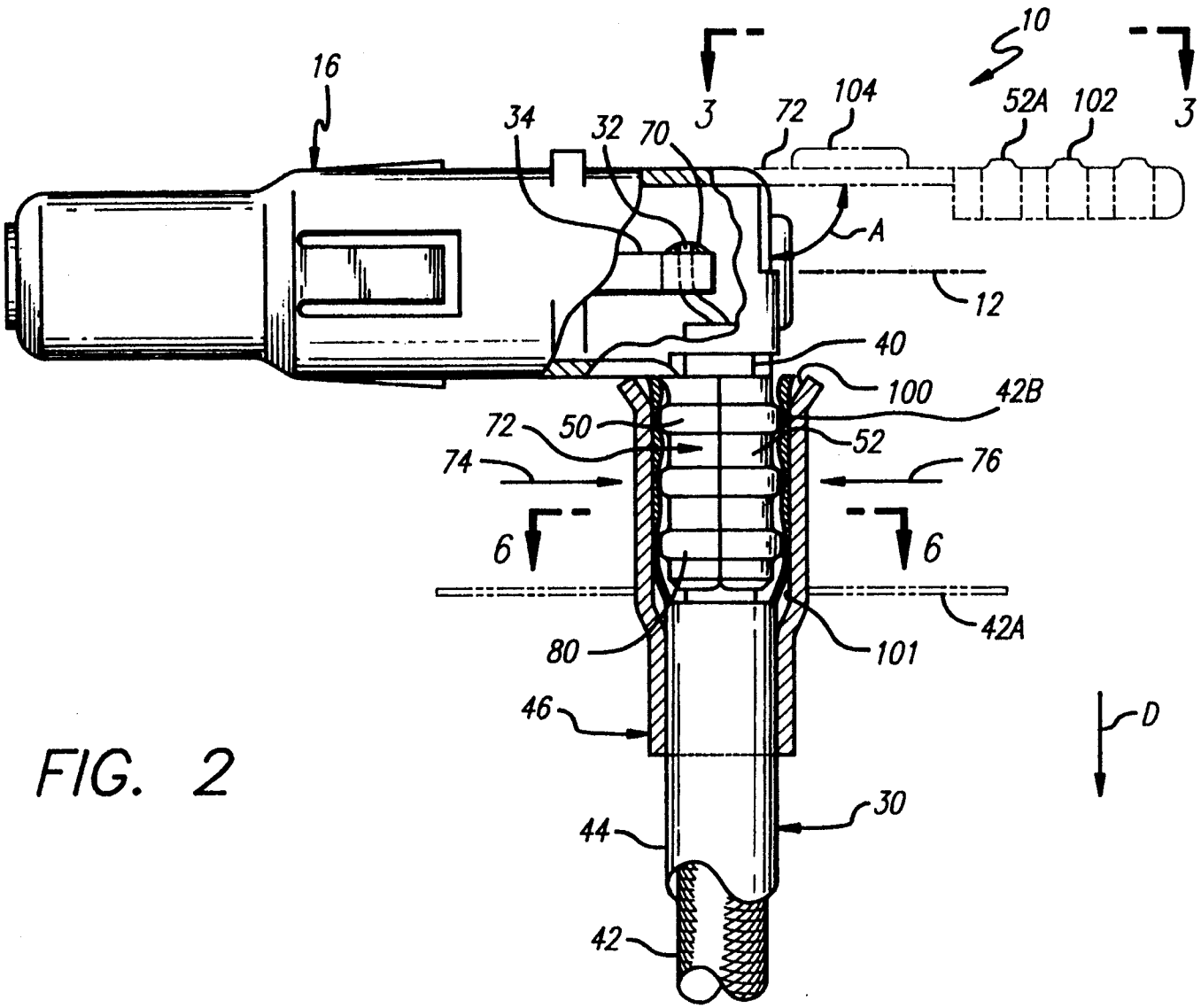
FIG. 2 is a partially sectional side view of the connector of FIG. 1, with the cable fully terminated and the shell in its final configuration, and also showing, in phantom lines, a second termination part of the shell in its initial configuration.

FIG. 2 shows the connector in its final configuration, wherein the cable 30 has been fully terminated to the connector, except that the final crimping operation has not yet been performed. The cable inner conductor 32 has been received in the inner contact 34, and they have been soldered together by use of a quantity of solder 70. The second termination part at 52A has been bent about its forward and upper end 72, by an angle A of about 90°, so the second termination part at 52 lies adjacent to the first termination part 50. The two termination parts 50, 52 each forms about half of a complete tube or ferrule 72. The ferrule 72 closely surrounds the cable inner insulator 40. The cable braiding, in the configuration 42B, closely surrounds the ferrule 72. The sleeve 46 has been slid upwardly so it closely surrounds the braiding at 42B. Completion of the termination is achieved by crimping the sleeve 46, as by forces applied at 74, 76 that deform both the sleeve 56 and ferrule 72 to securely lock the cable braiding at 42B between them.

Figure 6:
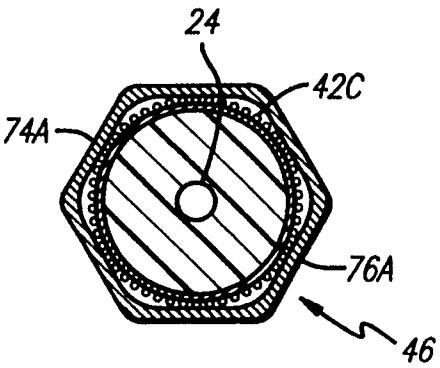
FIG. 6 is a view taken on line 6—6 of FIG. 2, showing the parts crimped.
Figure 3:
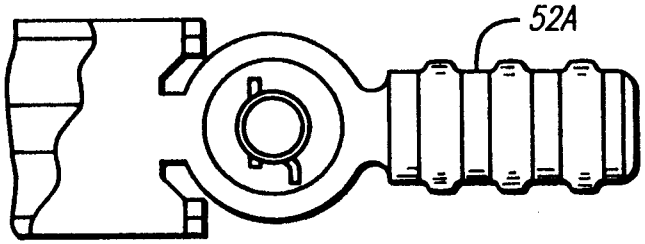
FIG. 3 is a view taken on the line 3—3 of FIG. 2, showing the shell in its initial configuration as drawn in phantom lines in FIG. 2.

The connector 10 must be securely mechanically attached to the cable braiding (shown at 42C in FIG. 6), to prevent pullout of the cable 30 in the downward direction D (FIG. 2) out of the connector. The braiding, which is formed of metal, can securely hold the rest of the cable in position. The fact that the sleeve 46 is of cylindrical shape to surround the braiding by substantially 360°, results in a highly reliable mechanical and electrical connection of the connector to the cable braiding. FIG. 6 shows the braiding at 42C, in the configuration of FIG. 2, but after crimping of the sleeve.

In order to enhance the mechanical and the electrical connection of the braiding to the connector, applicant forms the ferrule 72 with ribs 80. The ribs 80 form undulations that more firmly lock the braiding in place against pullout. Each of the termination parts 50, 52 have corresponding ribs. It is possible to form the ribs so the undulations are offset from each other to prevent the edges of the termination parts from overlapping each other.

Figure 5:
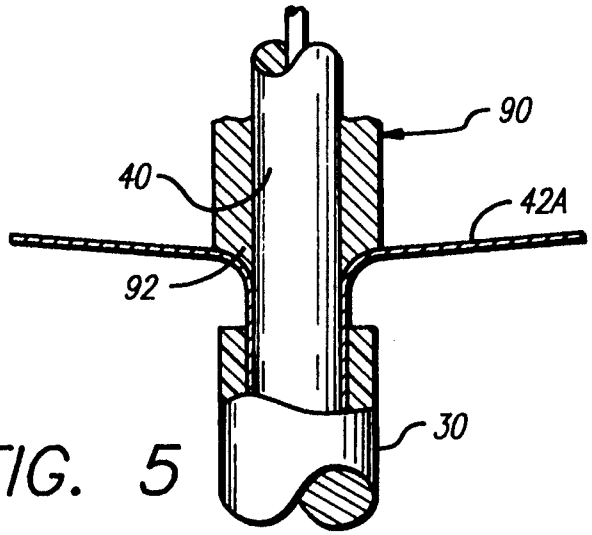
FIG. 5 shows a braiding expansion tool in the course of the spreading out of the cable braiding, to prepare the cable for termination.

The cable is prepared for termination by first stripping away portions of the insulator 40 and jacket 44. Next, the braiding is spread out. FIG. 5 shows a tool 90 used to spread out the braiding to the configuration 42A. The tool, which is turned and pushed down, closely surrounds the cable inner conductor 40 and has a sharp nose 92 that separates the braiding from around the inner insulator and which deforms it to a spread out configuration. A variety of simple tools can be used.

With the cable prepared, the cable inner insulator 40 is laid in the first termination portion 50 by moving it sidewardly in the direction 76 (FIG. 2) therein, while the inner conductor 32 moves into the slot of the contact 34. At this time, the spread out braiding at 42A will lie just below the first termination part 50. After the soldering or other connection is completed by projecting of a tool through the open rear end of the shell first portion 16, the second termination part at 52A is bent down to the position 52. Next, the sleeve 46 is moved upwardly along the cable. The sleeve has an upper end with an inner surface 100 which is upwardly-and-outwardly flared, and which neatly irons the braiding into a largely tubular shape of somewhat greater diameter than its original tubular configuration at 42. The sleeve then has neatly deformed the braiding to the configuration at 42B wherein it closely surrounds the ferrule 72 and is closely surrounded by the inside walls 101 of the sleeve. The final step is to crimp the sleeve, to leave inward deformations, with two of them indicated at 74A, 76A in FIG. 6, which are circumferentially spaced by over 90°.

The provision of the second termination part 52A which extends largely rearwardly in the initial configuration, not only leaves the rear end of the first shell portion open, but also facilitates placement of the cable. The cable inner insulator 40 is placed by merely moving it sidewardly against the first termination part 50, rather than requiring the inner insulator to be threaded through the tubular ferrule at 72. After the inner insulator is in place, the second part 52A bent to its final position. Since the ferrule part 102 of the second termination portion 52A is of relatively small height in the vertical direction, all of the second part 52A lies above the mate axis 12 in the initial configuration. This is helpful in leaving the rear end of the first shell portion 16 open to the projection of a soldering iron tip or other termination tool. It would be possible to initially extend the second termination part 52A at an upward incline, or even directly upwardly. However, this requires greater bending about the location 72, which can weaken the joint at 72 and result in a poor bent configuration with consequent openings through which electromagnetic energy can pass that interferes with high frequency signals in the coaxial connector. Thus, applicant prefers to have the second termination portion at 52A extend directly rearwardly, or at only a small (less than 30°) upward incline. As mentioned, even when the front 104 of the second part extends directly rearwardly as shown, which is the most preferred configuration, all of the second part still lies above the mate axis 12.

Figure 7:
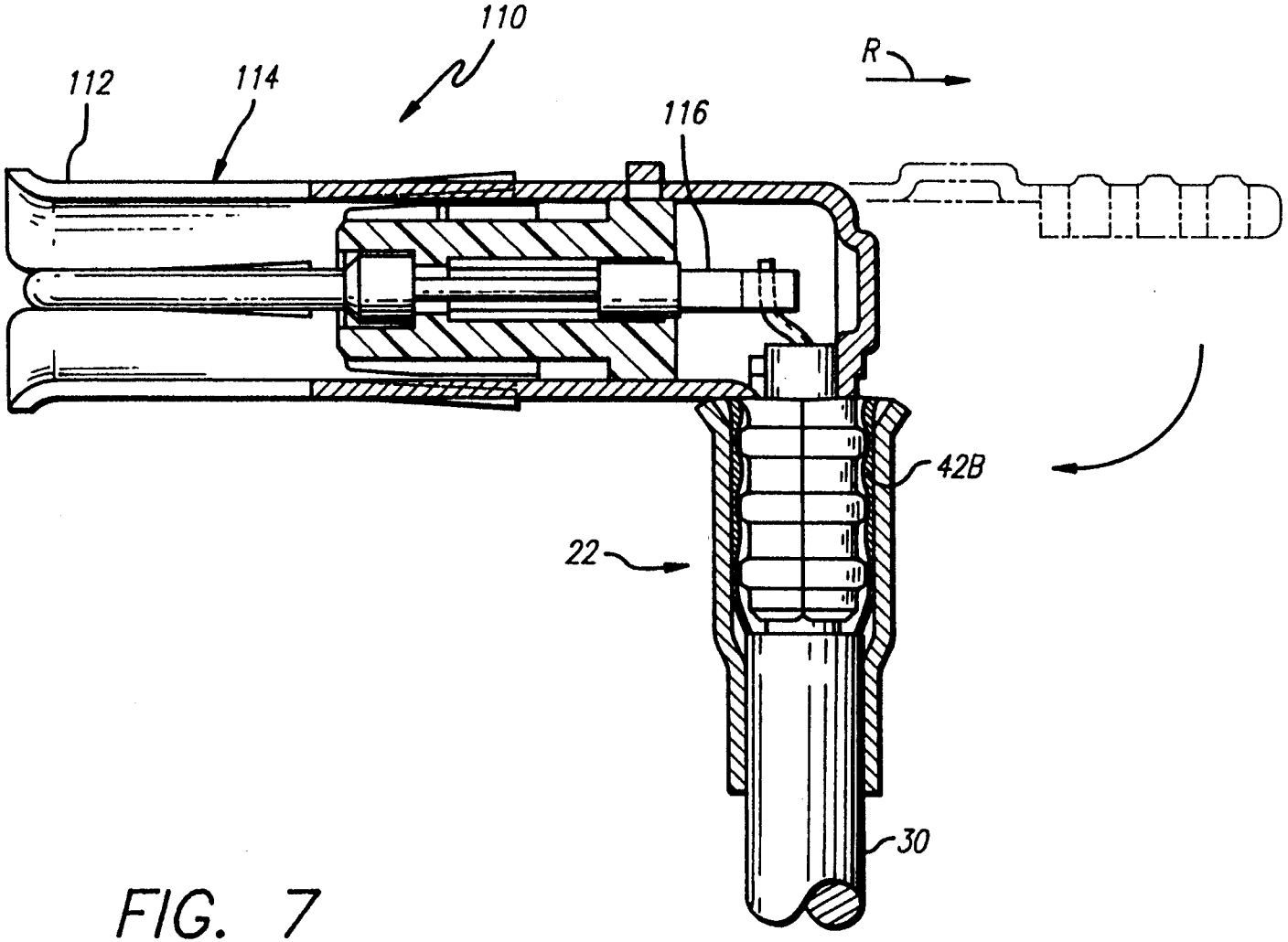
FIG. 7 is a partially sectional side view of a coaxial connector of an opposite gender to that of FIG. 2, shown in solid lines in its final configuration, and showing in phantom lines a part in its initial configuration.

FIG. 7 illustrates another connector 110 which is similar to that of FIG. 2, except that the forward end 112 of the sleeve first portion 114 and the inner coaxial contact 116 are different. The connector 110 can form the connector C of FIG. 1 which mates with the connector 10. The rearward and lower portion of the connector 110 is the same as that of the connector 10.

While the connector has been illustrated in a position wherein the first and second shell parts extend respectively horizontally and downwardly, and terms such as "upwardly", "downwardly", "horizontally", etc. have been used to facilitate the description of the parts as shown, it should be understood that the connector and its parts can be positioned in any orientation with respect to earth's gravity.

Thus, the invention provides a coaxial connector for termination to a coaxial cable, which provides a secure mechanical and electrical connection to the braiding of the cable and which provides a considerably open end of the first shell portion in the initial position when access to the rear open end of the shell is required. The shell has a second portion for terminating to the cable, which includes a first termination part that extends downwardly from the lower end of the first shell portion and which forms at least part of a ferrule. The second shell portion also includes a second termination part that initially extends largely rearwardly, and which can be bent down, the second part forming about half of the ferrule and initially lying above the horizontal mate axis of the first shell portion. The connector is assembled by first spreading apart the cable braiding, preferably so it extends substantially perpendicular to the cable axis. After the second termination part is bent down, the upward movement of a sleeve along the cable irons the braiding around the ferrule so that subsequent crimping of the sleeve results in a reliable braiding connection.

I claim:

1. A coaxial connector for termination to a coaxial cable that has an inner conductor surrounded by an inner insulator which is surrounded by a braiding which is surrounded by a jacket, wherein the connector includes a shell which can be changed between an initial configuration prior to termination to the coaxial cable and a final configuration during such termination, said shell having a tubular first portion with upper and lower sides that extends along a mate axis and a second portion which, in its final configuration extends along a termination axis that is substantially perpendicular to said mate axis, said first portion having forward and rearward ends with said rearward end being open in said initial configuration and closed in said final configuration and said second portion including first and second termination parts extending respectively from the lower and upper sides of said rearward end with said first termination part extending substantially parallel to said termination axis and said second termination part extending, in said initial configuration, at an angle of at least about 90° from said first termination part and being bendable to said final configuration to close the rear of said tubular first portion, wherein at least said first termination part forms part of a substantially tubular ferrule for receiving a cable inner insulation and for being surrounded by the cable braiding in said final configuration, characterized by:

a tubular sleeve which can slide along the cable jacket and which has an inside of a diameter to closely surround the braiding, and which can be crimped to lock the cable braiding between itself and said ferrule.

2. The connector described in claim 1 wherein:

said first and second termination parts each forms about half of said tubular ferrule.

3. The connector described in claim 1 wherein:

said tubular ferrule has a plurality of ribs that form undulations in both its inside and outside, to thereby better grip said braiding.

4. The connector described in claim 1 wherein:

said mate axis lies along the center of said tubular first portion of said shell;

said second termination part forms part of said ferrule; and said second termination part projects rearwardly from said rearward end of said shell first portion, with all of said second part lying above the level of said mate axis in said initial configuration of said shell.

5. The connector described in claim 1, including said coaxial cable, and wherein:

said cable inner insulation lies within said ferrule, said cable braiding lies around said ferrule, said sleeve lies around said braiding, and said sleeve, braiding and ferrule are crimped at at least two locations spaced more than 90° apart.

6. A coaxial connector for termination to a coaxial cable, comprising:

a shell which includes a tubular first portion that has a horizontal mate axis, upper and lower sides, and an open rear end, said shell also including a second portion that forms a ferrule and that includes first and second termination parts extending respectively from said lower and upper sides of said tubular first portion rear end, with said first termination part extending downwardly from said tubular portion rear end;

said second termination part being bendable from an initial configuration wherein it extends rearwardly from said tubular portion rear end, and a final configuration wherein said termination part extends downwardly; and a sleeve which can surround said ferrule to crimp to it;

said second termination part being constructed so all of it lies above said mate axis in said initial configuration.

7. The connector described in claim 6 wherein:

said sleeve is slidable along said cable, and has an outwardly and upwardly flared upper end.

8. The connector described in claim 6 wherein:

said first and second termination parts each forms about half of said ferrule, as viewed along a vertical axis, in said final configuration.

9. A method for terminating a coaxial cable to a coaxial connector, where the cable has an inner conductor surrounded by an inner insulator which is surrounded by a braiding which is surrounded by a jacket, and the connector includes a shell with a tubular first shell portion having a horizontal mate axis and having upper and lower sides and forward and rearward ends, and a second shell portion that includes first and second termination parts extending respectively from the lower and upper sides of said rearward end of said first shell portion, with said first termination part extending downwardly from said first shell portion along a ferrule axis and forming at least part of a ferrule and with said second termination part extending rearwardly and/or upwardly from said first shell portion, and said connector includes an inner coaxial contact lying in said tubular first shell portion, and also includes a sleeve, characterized by:

sliding said sleeve onto said cable;

stripping said jacket from around an upper end portion of said braiding and stripping said inner insulation from around an upper end of said inner conductor;

spreading the exposed portion of said braiding so an upper portion thereof is spaced from said inner insulation, laying said inner insulation in said at least part of said ferrule formed by said first termination part, and connecting said inner conductor to said inner coaxial contact;

bending down said second termination part to at least close the rearward end of said tubular first shell portion;

sliding said sleeve up along said cable while ironing said spread and exposed portion of said braiding around said ferrule and trapping said exposed portion of said braiding between said ferrule and said sleeve, and then crimping said sleeve to lock said braiding in place between said ferrule and sleeve.

10. The method described in claim 9 wherein said ferrule has an axis, and including:

constructing said first and second terminations so each forms about half of said ferrule, as viewed along the ferrule axis, in the final configuration;

said step of spreading said braiding comprises spreading it to extend at least about 90° from its original configuration, to allow the half of said ferrule formed by said second termination part to move largely horizontally against the half of said ferrule formed by said first termination part, without interference by said braiding.

* * * * *